United States Patent [19]

Lowery et al.

[11] 4,025,030

[45] May 24, 1977

[54] APPARATUS FOR MAKING CARPET STRIPS

[76] Inventors: James V. Lowery; Charles L. Lowery, both of 1020 Dorothy, Houston, Tex. 77008; Vernon L. Lowery, 5546 Hidalgo, Houston, Tex. 77027; Jimmy R. Lowery, 10738 Bammel N. Hous. Road, Houston, Tex. 77040

[22] Filed: July 28, 1972

[21] Appl. No.: 276,131

[52] U.S. Cl. ..... 227/112; 227/80; 227/76; 227/119

[51] Int. Cl.[2] ..... B27F 7/02

[58] Field of Search ..... 227/80, 112, 114, 119, 227/139, 149

[56] References Cited

UNITED STATES PATENTS

| | | | |
|---|---|---|---|
| 2,273,268 | 2/1942 | Hunter et al. | 227/112 |
| 2,557,757 | 6/1951 | Paxton et al. | 227/149 |
| 2,669,714 | 2/1954 | Newcomb et al. | 227/80 X |
| 2,850,736 | 9/1958 | Houghton | 227/112 |
| 2,887,685 | 5/1959 | Cast | 227/112 X |
| 2,953,788 | 9/1960 | Maex et al. | 227/80 |
| 3,134,981 | 6/1964 | Demetrakopoules et al. | 227/149 |
| 3,306,511 | 2/1967 | Small | 227/80 X |
| 3,514,028 | 5/1970 | Kowalczyk | 227/149 X |

*Primary Examiner*—Granville Y. Custer, Jr.
*Attorney, Agent, or Firm*—Donald Gunn

[57] ABSTRACT

An apparatus which incorporates a generally rectangular framework for receiving a supply of sheet plywood for cutting into individual strips, with each strip converted into a carpet-tacking strip. The apparatus receives and stores a supply of sheet plywood which is individually cut into a plurality of similar or identical strips. Each strip has a bevel on one edge. A number of nails, preferably in two files, are driven through the strip so that the point emerges from the backside. These nails provide a gripping means for engaging the carpet. Additionally, a number of nails for nailing the strips to the floor are inserted, at least partially, through the board from the opposite side. The apparatus simultaneously and consecutively forms a plurality of strips.

10 Claims, 26 Drawing Figures

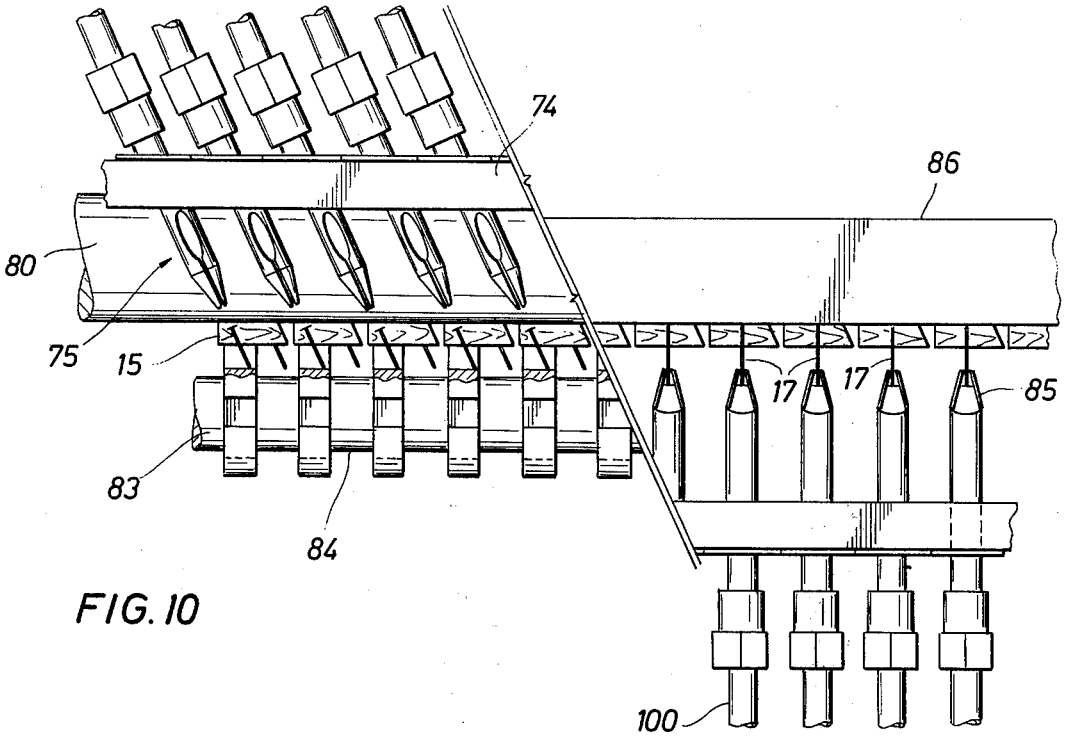
FIG. 10
FIG. 11
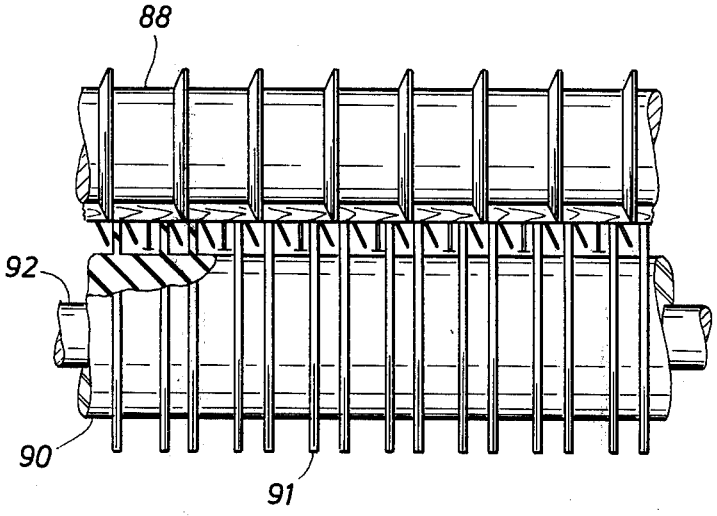
FIG. 14
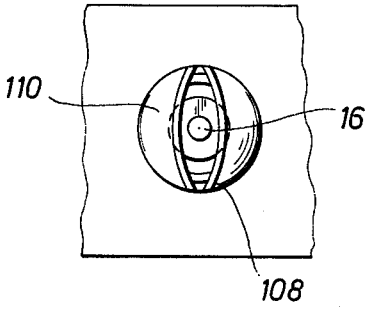
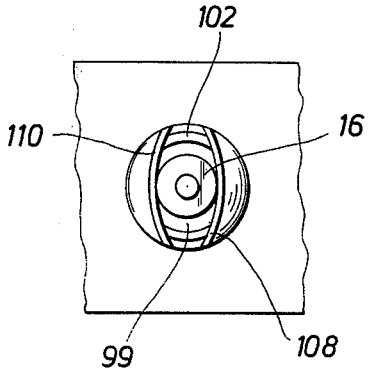
FIG. 14A

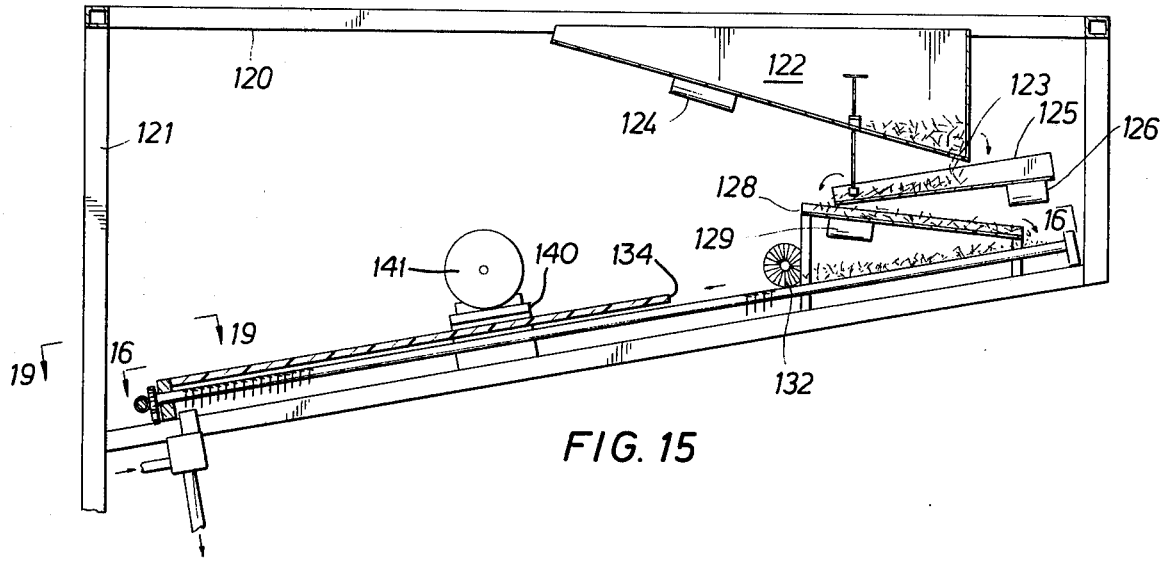
FIG. 15
FIG. 16
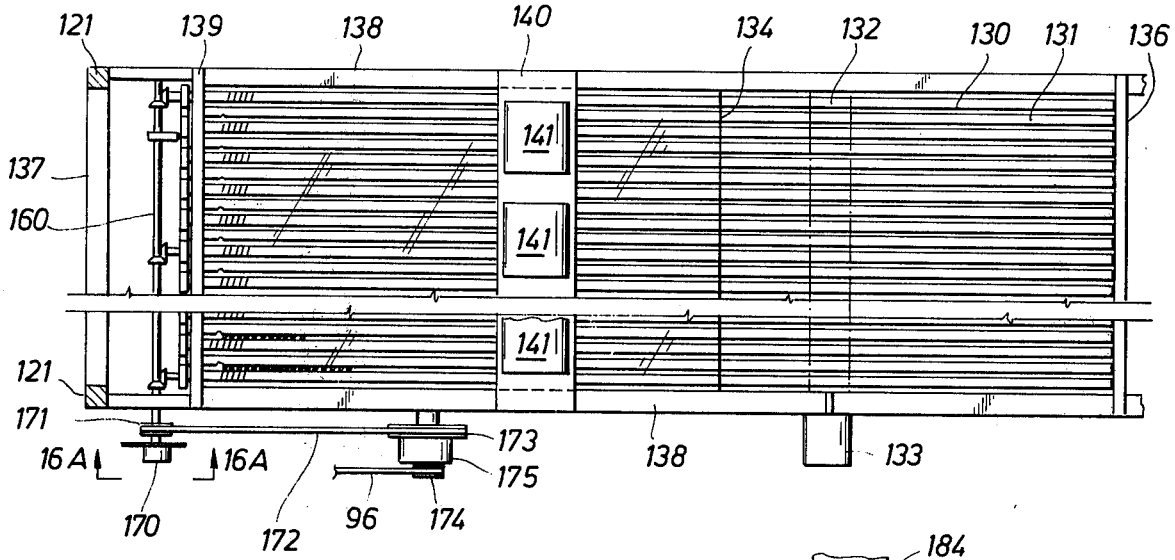
FIG. 17
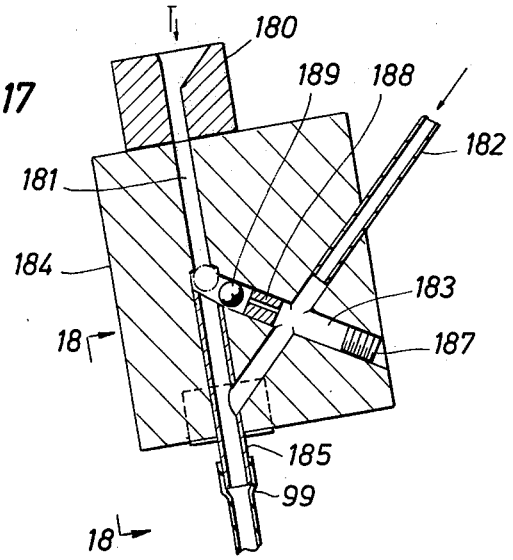
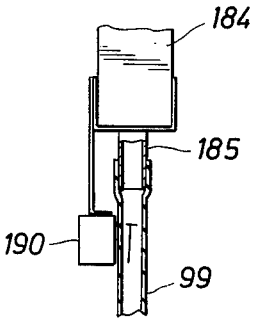
FIG. 18

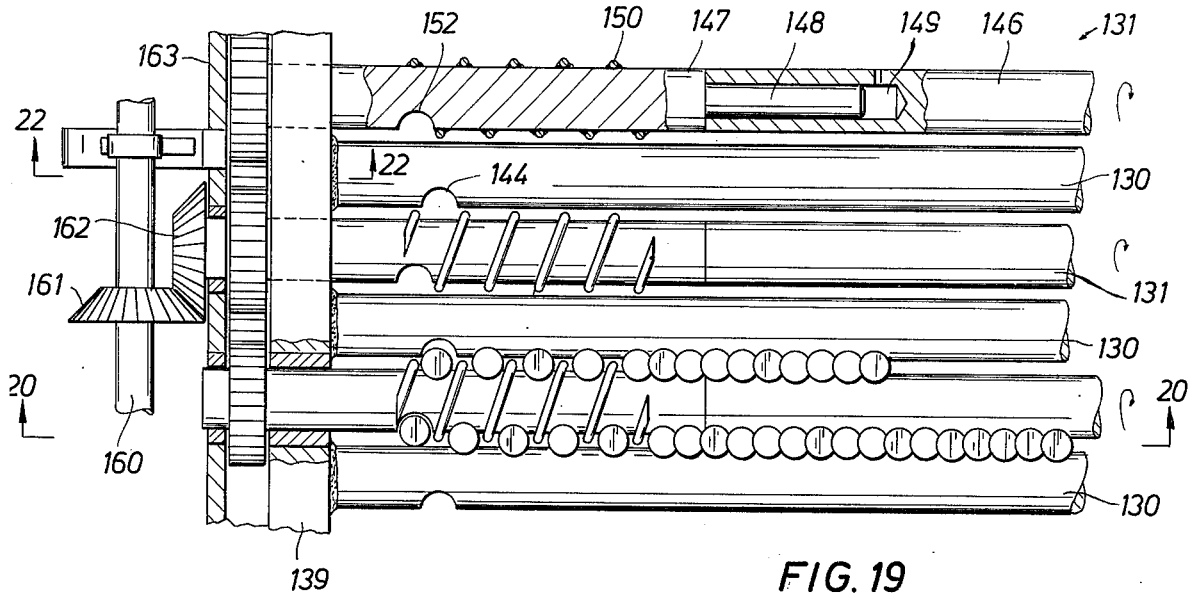
FIG. 19
FIG. 20
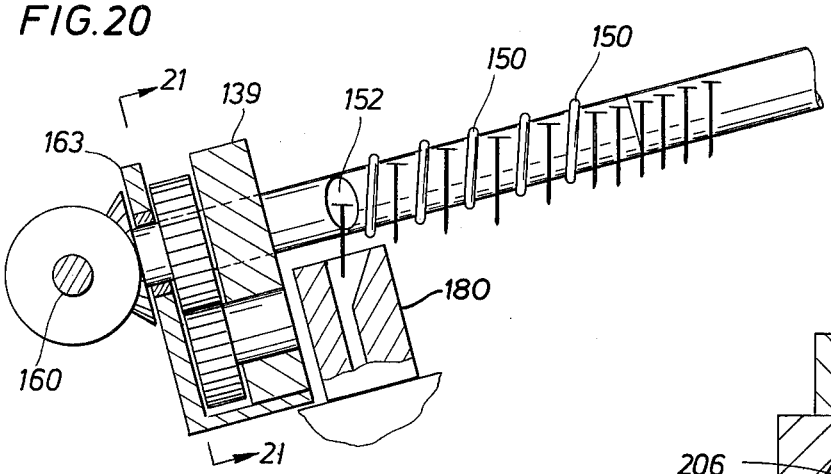
FIG. 17A
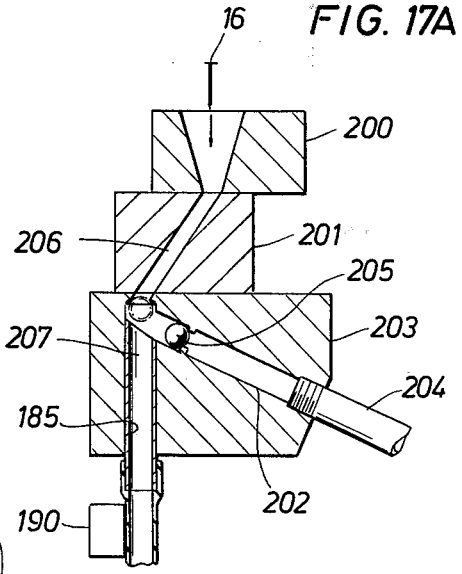
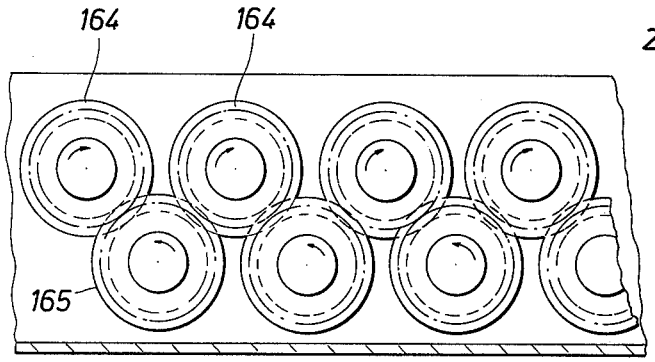
FIG. 21

FIG. 22
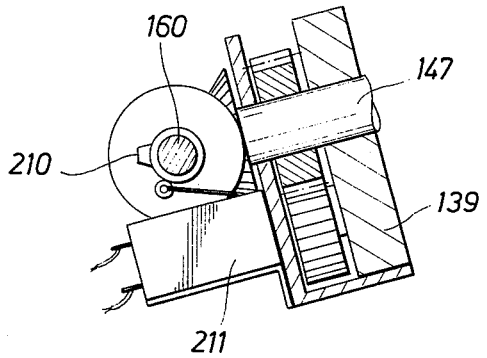
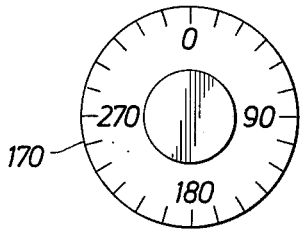
FIG. 16A
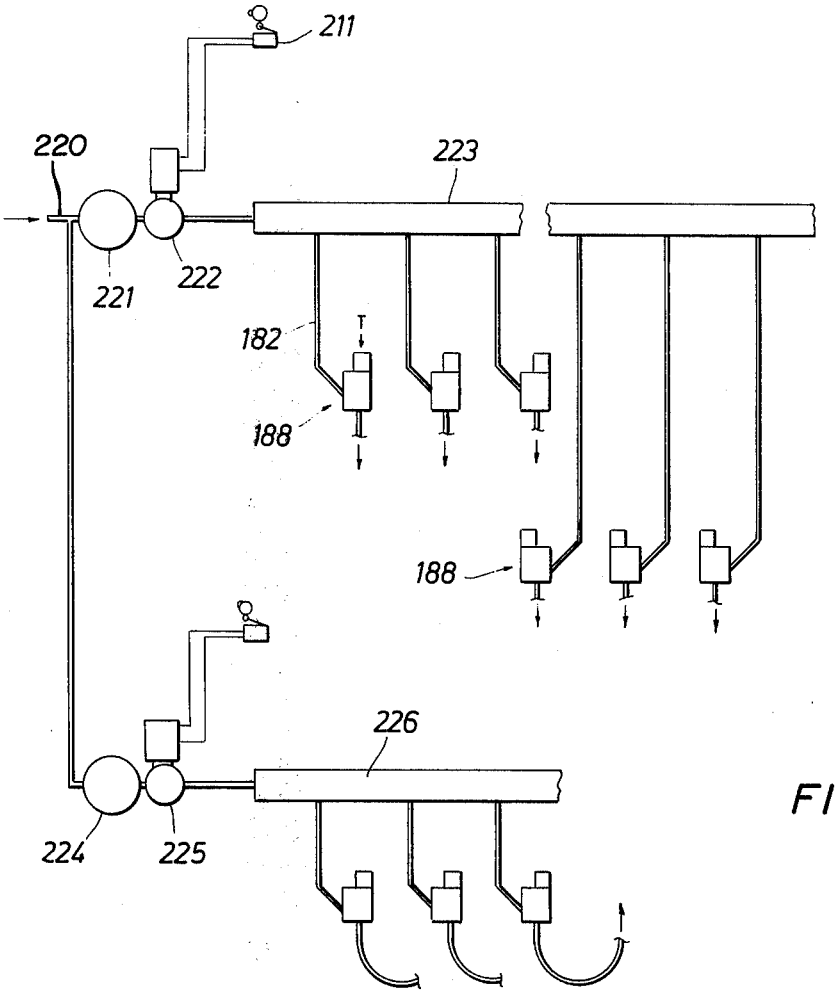
FIG. 23

APPARATUS FOR MAKING CARPET STRIPS

BACKGROUND OF THE INVENTION

Wall-to-wall carpeting is attached to a structure through the use of two methods. The least significant method is the use of a glue or mastic to attach carpeting. The most significant method of attachment is through the use of a carpet-tacking strip. A carpet-tacking strip is normally an elongate wooden strip which is nailed to the floor beneath the wall-to-wall carpeting. It grips and engages the carpeting by virtue of a number of slanted small nails which extend from the back through the top of the carpet stripping. The carpet is stretched and is jammed into the points, which, being set at an angle, stretch the carpet from wall to wall with stripping material placed about the perimeter of a room or carpeted ara. Carpeting laid in this fashion has many advantages over carpeting laid with a glue or mastic.

The present invention is directed to an apparatus which forms carpet stripping. The present invention should be considered first over several of the structures shown in the prior art. Without being overly specific, the prior art has been unable to furnish the equipment which manufacturers a substantial quantity of carpet stripping during a given interval. Limitations on production are merely one reason alone, ignoring others, why the present invention is distinguished over structures of the prior art.

SUMMARY OF THE INVENTION

The present invention is summarized as providing an apparatus for high speed large volume production of carpet stripping. The carpet stripping is formed in finite lengths, typically four foot lengths, having a nominal width of approximately one inch. The carpet tacking strip is formed from sheet plywood stock wherein whole sheets are fed at a controlled rate into a number of parallel cutting heads which cut individual strips from the sheet. The individual strips advance past the cutting head and are drawn into a nail setting mechanism. Two groups of nails are placed in each strip. Preferably, two or three parallel files of nails are placed in each strip, the nails being driven fully into the wood so that the head is embeded and is either flush or recessed. The nail points project from the opposite side to catch and hold the carpet. These nails are inserted at a slight angle. A second group of nails, the pe-nails, are inserted from the opposite side and are driven only partly through so that the tip or point of the nail does not emerge from the bottom. The pre-nails permit the carpet tack strip to be nailed to the floor preparatory to installing wall-to-wall carpeting.

BRIEF DESCRIPTION OF THE DRAWINGS

FIG. 10 is a sectional view taken along the line 10—10 of FIG. 5 and somewhat similar to the view of FIG. 9 but also showing nail guides for the pre-nails which are inserted from the lower side;

FIG. 11 is a sectional view taken along the line 11—11 of FIG. 5 illustrating a pair of rollers cooperative with the individual strips after the nails have been received therein wherein a space is provided for the nails to project from the nether side of the finished strips toward one of the rollers;

FIG. 14 is a sectional view taken along the line 14—14 of FIG. 13 for viewing the end opening from which a nail emerges to be driven into a carpet tack strip;

FIG. 14A is a view similar to FIG. 14 showing enlargement of the opening when the head of a nail passes through;

FIG. 15 is an enlarged side view of a nail feeding mechanism;

FIG. 16 is a view taken along the line 16—16 of FIG. 15 showing the top of the nail separator mechanism including the mode of means whereby nails are provided to be used for each individual strip;

FIG. 16A is a sectional view along the line 16A—16A of FIG. 16 showing a timing control mechanism;

FIG. 17 is an enlarged sectional view of apparatus which receives nails from the nail separator and pneumatically forces them at high speed into a tubing for nailing purposes;

FIG. 17A shows an alternative form of apparatus to the structure of FIG. 17;

FIG. 18 is a sectional view taken along the line 18—18 of FIG. 17 showing the position of a magnet which holds the nails to achieve uniform timing in the apparatus;

FIG. 19 is an enlarged sectional view taken along the line 19—19 of FIG. 15 showing details of construction of the nail drop mechanism;

FIG. 20 is sectional view taken along the line 20—20 of FIG. 19 showing an individual rotating rod having a screw formed on it for feeding individual nails to the apparatus illustrated in FIG. 17;

FIG. 21 is a sectional view taken along the line 21—21 of FIG. 20 showing a number of gears which cooperate together to provide drive to the nail separator permitting multiple operation of the apparatus to form multiple and parallel strips;

FIG. 22 is a sectional view taken along the line 22—22 of FIG. 19 showing the positioning of a cam and switch mechanism; and, FIG. 23 is a pneumatic schematic of control apparatus of the present invention.

DESCRIPTION OF THE PREFERRED EMBODIMENT

Figure 1:
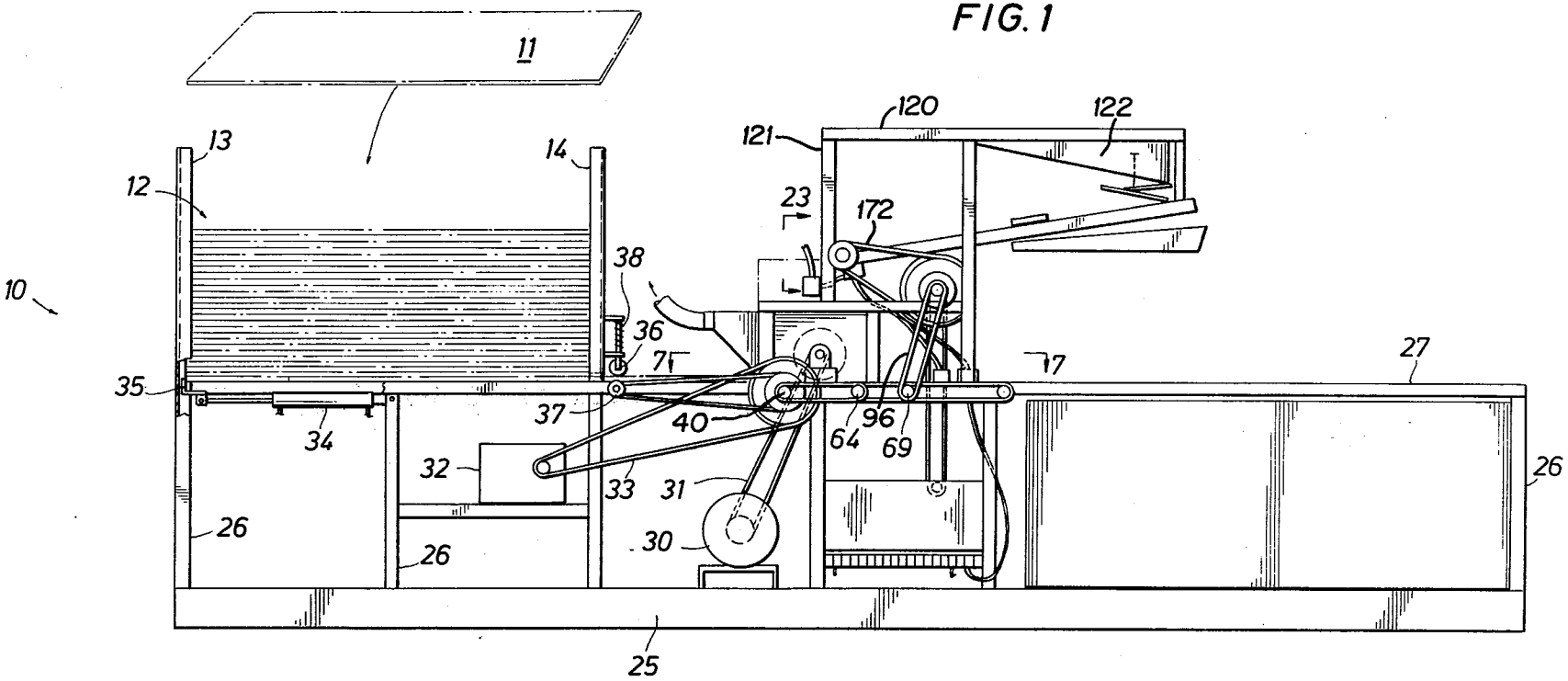
FIG. 1 is a side view of the machine of the present invention in its entirety showing a magazine for receiving sheet plywood therein.

Attention is first directed to FIG. 1 of the drawings where the numeral 10 generally indicates the carpet tack strip making machine of the present invention. The machine consumes sheet plywood generally indicated by the numeral 11 which is fed into and stored in a vertical bin 12. The vertical bin 12 is comprised of a number of upright angle members 13 and 14 which capture the sheet plywood 11 at the corners. The sheet plywood 11 is preferably of uniform size, typically 4 feet in length. This enables the fabrication of strips which are 4 feet long. The 4 foot length finds acceptance in industry as being a standard size, although this length of measure is not mandatory.

The machine 10 converts the sheet material 11 into individual strips. The sheet 11 is preferably of such a width as to fabricate several parallel strips. In other words, the sheet 11 is cut lengthwise to form a number of strips. The width of the sheet is therefore variable dependent on the number of strips to be made from the sheet. For purposes of description but not as a limitation on the present invention, it will be presumed that the sheet 11 is sufficiently wide to form anywhere between 16 and 32 individual strips of a nominal 1 inch width. The relative dimensions and quantities can be varied depending on the requirements imposed on the apparatus 10.

Figure 3:
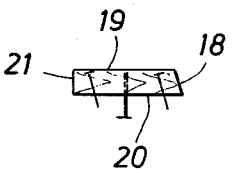
FIG. 3 is a sectional view taken along the line 3—3 of FIG. 2 showing the two groups of nails wherein the pre-nail is only partly inserted and does not extend its point therethrough while the carpet nails extend fully through and at an angle.
Figure 2:
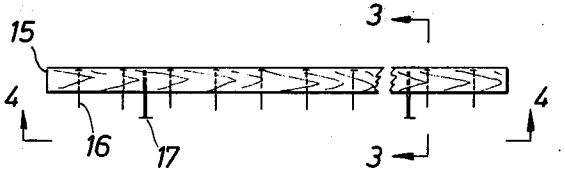
FIG. 2 is a side view of a typical carpet tack strip showing the two groups of nails therein.

Attention is directed to FIG. 2 of the drawings where the numeral 15 identifies an individual strip. The carpet tack nails are indicated by the numeral 16 while the numeral 17 identifies the pe-nail. In FIG. 3, a beveled face 18 is shown in the sectional view. The uppermost face of FIG. 3 is identified by the numeral 19 which is the topside of the strip, but it will be appreciated that the strip is made upside down. Hence, the top face 19 is the face which is actually abutted against the floor when the strip is installed at its final destination. The lower face is indicated by the numeral 20 and will be the bottom face. The perpendicular face 21 is the side face, while the face 18, which is at an angle, is the beveled face.

Figure 4:
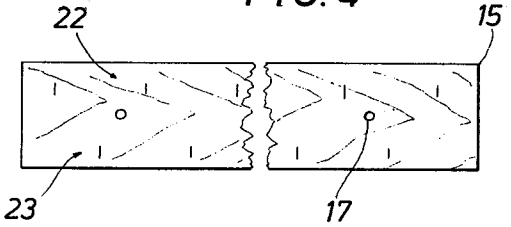
FIG. 4 is a view taken along the line 4—4 of FIG. 2 showing relative placement of the two files of nails in a typical strip.

In FIG. 4, the tack nails 16 are shown in two rows of files. The first row is at 22 while the second file is at 23. It will be further noted that the tack nails 16 are staggered at alternative locations along the strip 15. The two files are indicated by the numerals 22 and 23 in FIG. 4. The two files are approximately equal distance from the edges although this is not mandatory. However, even spacing of the points which extend from the bottom face 20 provide even tension in the carpet when it is anchored through the use of the nails. It will be noted that the pre-nails 17 are approximately along the center line of the strip. This location is desirable because the pre-nails 17 are somewhat larger and if they are closer to the edge, they might tend to split the wood. It will be appreciated that variations in the arrangement of the nails and patterns thereof are readily within the scope of the present invention, the present invention being adaptable to form the typical strip 15 shown in the drawings or any other form of strip which may be required.

Very broadly, the apparatus 10 includes a pair of horizontal parallel rails 25 on which the apparatus is supported. A number of vertical upright frame members 26 are connected to the horizontal rails 25. A pair of parallel support members 27 extend subsequentially the full length of the equipment. The members 27 cooperate with the other members to define a generally rectangular rigid framework of substantial strength for supporting and receiving the present equipment thereon. The framework thus incorporates the upright members 13 and 14 previously defined which form a storage bin for receiving sheet plywood.

A path through the equipment is defined approximately planar with the members 27. Thus, the bottom most sheet is storage between the upright posts 13 and 14 is fed through a pair of rollers and into processing equipment. The processing equipment includes cutters which cut the sheet into a number of parallel strips and a number of rollers and roller mechanisms which maintain the strips in parallel fashion. A number of nail guides are used to insert the tack nails 16 and the pre-nails 17. Thereafter, the strips are guided out of the equipment even with the nails in them and are delivered at the end of the equipment at the right hand side of FIG. 1 to be boxed or disposed of in some other fashion.

Considering some of the details, the numeral 30 identifies a motor which utilizes a belt drive 31 to drive a set of cutters as will be described hereinafter. A second power source is indicated at 32. The power source 32 is preferably an electric motor driving a variable drive transmission which provides an output to a chain drive 33. The transmission permits adjustment of the speed of the equipment and all the portions of the equipment which require synchronism are connected directly or indirectly to the chain drive 33. More will be noted concerning this hereinafter.

The lowermost sheet of plywood in the stack is fed into the equipment by means of a reciprocating hydraulic or pneumatic cylinder arrangement indicated generally at 34. An upwardly projecting tab 35 is reciprocated to and fro to grab the lower sheet and to force it to the right as reviewed in FIG. 1. As it is forced to the right, it passes through a slot partly cut in the upright members 14 and is engaged by a pair of opposing rollers 36 and 37. The rollers 36 and 37 cooperate together to drive the sheet to the right. The roller 37 is fixed in position and is preferably driven by a chain drive indirectly deriving power from the chain drive mechanism 33. The roller 36 is preferably spring mounted at 38. The roller 36 is forced downwardly towards the roller 37 so as to pinch the bottom most sheet of plywood 11 which is fed therebetween. The sheet 11 is then forced to the right as shown in FIG. 1. It should be noted that the horizontal frame members 27 support a flat plate-like member which spans the width of the equipment and which preferably is interrupted only at the rollers 36 and 37. This supports the plywood sheet in the bin and as it travels to the right from the rollers towards the cutter mechanism. The roller 37 is driven by means of a chain drive connected to the shaft 40 identified in FIG. 1. The shaft 40 is driven by the chain drive 33.

Figure 5:
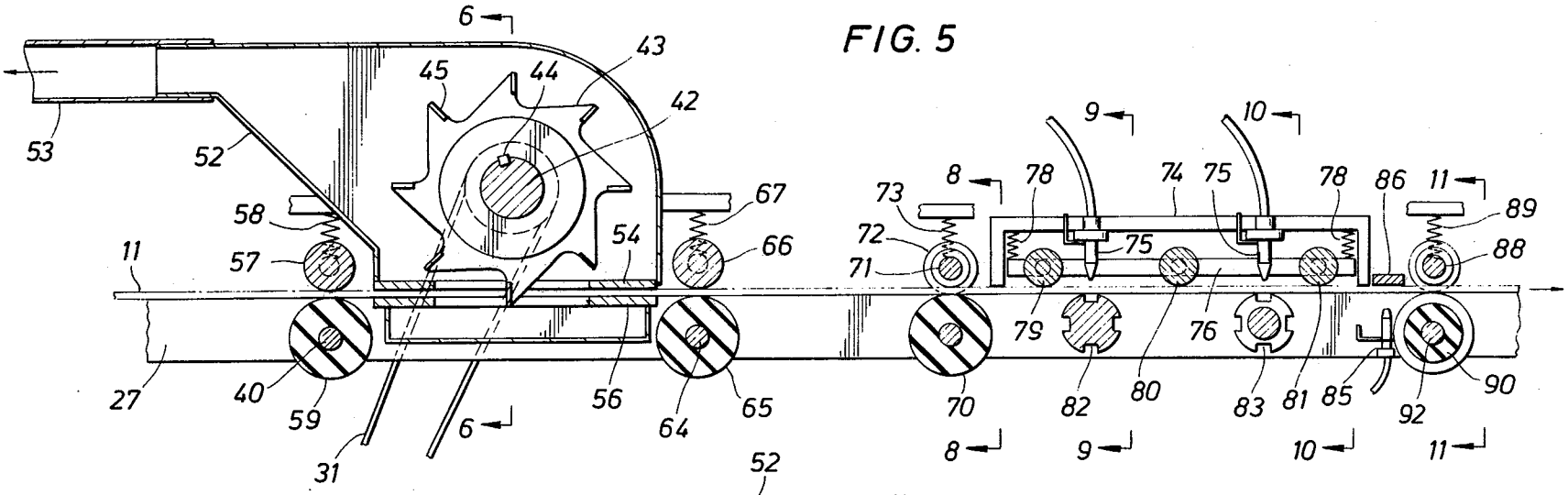
FIG. 5 is an enlarged side view with portions broken away for sake of clarity of the strip feeding mechanism including the cutter heads and further illustrating the means for setting the carpet nails.
Figure 6:
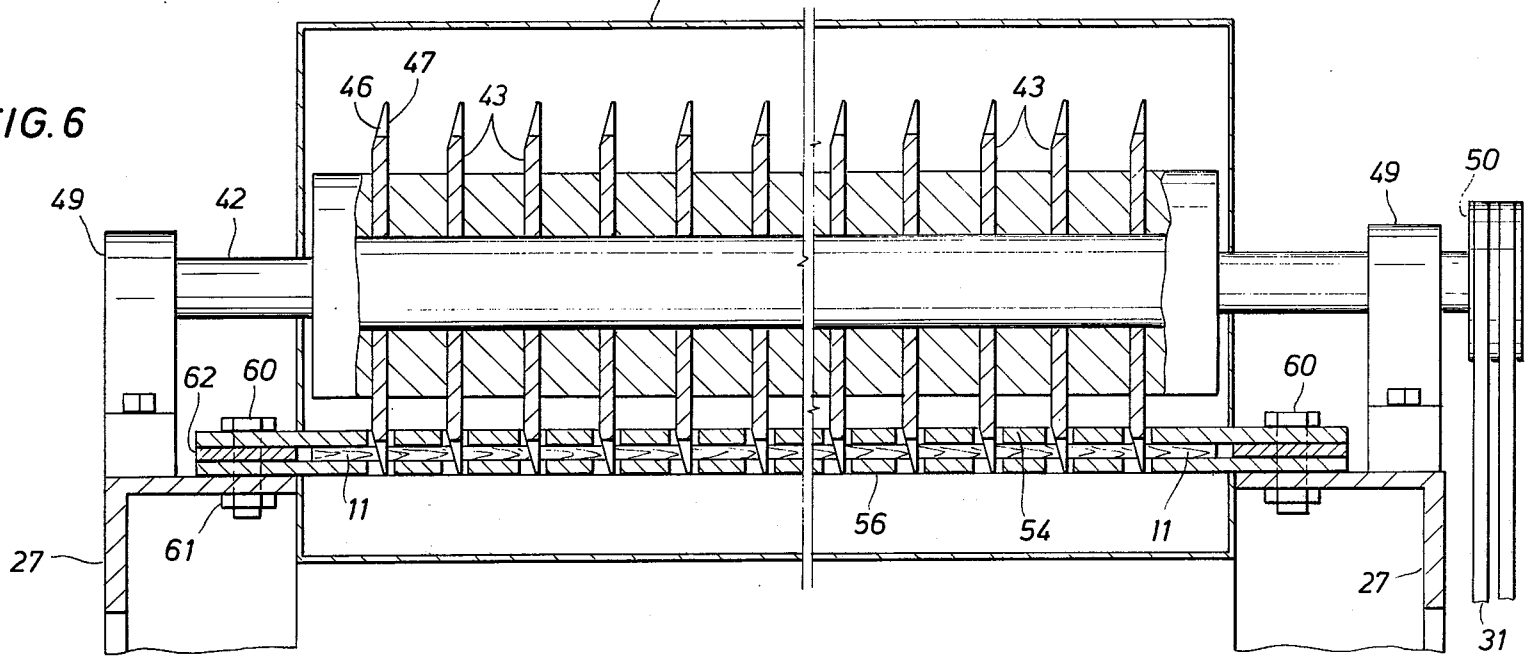
FIG. 6 is a sectional view taken along the line 6—6 of FIG. 5 showing in enlarged detail the relationship of several cutters whereby an entire sheet of plywood is cut and formed into individual strips.

At this juncture, it is expenditious to next go to FIG. 5 of the drawings. FIG. 5 is an enlarged sectional view of the cutter mechanism. As shown in FIG. 5, the sheet plywood 11 feeds from the left toward the right. The drive member 31 is connected with a shaft 42 which extends fully across the width of the equipment. A cutter blade 43 is joined to the shaft 42 by suitable means such as a key 44. The blade 43 carries a number of tip inserts 45 for durability and long life. The tips 45 are shaped so as to define a cutting edge which is straight on one face and beveled on the other. FIG. 6 more accurately shows the beveled face 46 opposite the straight face 47. The inserts or tips 45 are preferably formed of a hard material such as tungsten carbide which defines the beveled face 46 and the straight face 47. In FIG. 6, it will be observed that a number of individual cutter blades 43 are supported on the shaft 42. Of course, the shaft 42 is supported by a suitable pair of pillow blocks 49 located at opposite ends of the shaft 42. One end of the shaft 42 extends beyond the side rails or frame members 27 and carries a pulley 50 which is engaged with the drive member 31. A flexible belt drive is readily acceptable although other means can be used. The power is imparted to the shaft 42 which rotates the cutters to cut the sheet plywood 11 into a number of individual strips.

Returning again to FIG. 5, an enclosed or hood is indicated by the numeral 52. The hood 52 is connected with an air line 53 which communicates with a suitable vacuum cleaner. Air is drawn into the chamber 52 through some outlets at the bottom to be described and carries away the sawdust. Sawdust and other cuttings are evacuated through the tubular passage 53 to be disposed of in some suitable manner.

In FIG. 5, it will be observed that the cutter blade 43 extends into and below the plane of the plywood moving from the left. The chamber 52 fully surrounds the several cutter blades 43 except that its bottom portion is defined by a grate 54. The grate 54 is a generally planar member having a few slots in it, the slots being of sufficient length to receive the cutter 43 therein. Attention is momentarily directd to FIG. 7 of the drawings which illustrates a top view of the grate 54 where the parallel slots 55 are shown. Each slot receives an individual cutter blade 43.

In FIG. 5, the numeral 56 identifies a lower grate. The grates 54 and 56 are preferably identical to one another but this is not mandatory. The grates 54 and 56 have slots which are aligned to receive the cutter 43 in both slots as illustrated in FIG. 5. The grates 54 and 56 are spaced from one another so that the sheet of plywood 11 is received therebetween and is supported by the grates. The numeral 57 identifies an idler roller which is positioned opposite a resilient roller 59 carried on the shaft 40. The resilient material on the shaft 40 drives the sheet plywood 11 to the right. It contacts the lower side while the roller 57 contacts the upper side. The roller 57 is supported by a spring mounting mechanism at opposite ends of the roller. The spring 58 thus forces the roller 57 towards the roller 59 to pinch the sheet of plywood, thereby providing a means of positive engagement and drive for the sheet forcing it into the slot between the grates 54 and 56.

As shown in FIG. 6, the grates 54 and 56 extend across the width of the machine 10 and are supported by the side frame members 17. The grates 54 and 56 are preferably held in position by a bolt 60 at each end. The bolts 60 are, of course, threaded to nuts 61 on the lower side. The grates 54 and 56 are spaced from one another by means of a washer 62 at opposite ends. Thus, the washer 62 defines the width of the slot between the grates. By chance, should the thickness of plywood be changed, it would be helpful to change the thickness of the washer 62 to accommodate the new thickness in plywood. However, an industry standard exists in carpet strips and accordingly, the present invention preferably uses only a single thickness of washer. The washer is sized with respect to the plywood to form a snug fit for the plywood between the grates 54 and 56. The fit, being snug, prevents the plywood from chattering up and down as the cutters 43 rip through the plywood 11. Oscillations or chatter are basically undesirable and are normally prevented by the close spacing of the grates 54 and 56 as well as the holding force of the rollers before which the cutter heads which were just described. Additional rollers are shown elsewhere in the apparatus. These also assist in holding the sheet of plywood, both as a sheet, and when cut into strips, to prevent vertical chatter or vibration which is generally undesirable.

Returning again to FIG. 5, the numeral 64 identifies a shaft which carries a resilient roller 65 on it. The roller 65 is positioned opposite from an additional roller 66. The roller 65 is driven while the roller 66 idles. The roller 66 is spring mounted at 67 to force it toward the individual strips which emerge from the cutter mechanism. As shown in FIG. 1, the shafts of 40 and 64 are connected together by means of a chain drive so that they run in synchronization. The pair of rollers force the individual strips to the right and draw then from the cutter mechanism.

Figure 8:
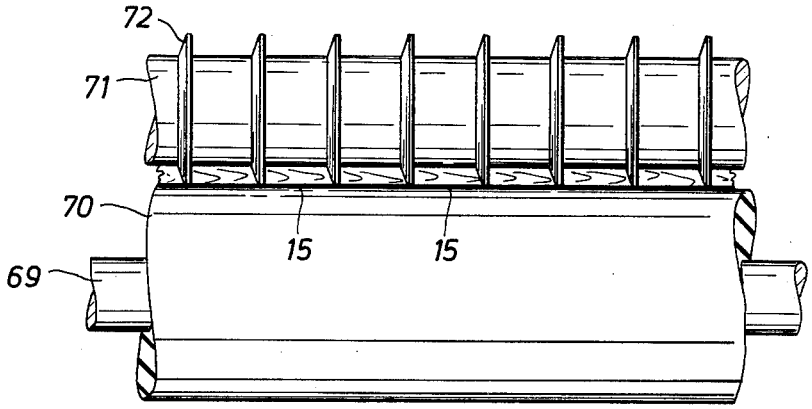
FIG. 8 is a sectional view taken along the line 8—8 of FIG. 5 illustrating the position of a pair of rollers on opposite sides of the sheets which guide the individual strips in parallel fashion.

Attention is next directed to FIG. 8 of the drawings. After the individual strips are cut at the cutter mechanism, and after they pass through the roller pair 65 and 66, they then pass through an additional pair of rollers. These are shown in FIG. 8. The numeral 69 identifies the mounting shaft for a roller 70. This comprises the lower roller. The upper roller is indicated by the numeral 71. The roller 71 carries number of beveled fins 72 which are spaced lengthwise along the roller by an amount approximately equal to the width of the individual strips. The strips are one inch in width. The rubber roller 70 grips the individual strips and draws them into the remainder of the equipment as will be described. The pair of rollers illustrated in FIG. 8 thus serve to impart additional impetus and guidance to the number of strips.

The roller 70 is supported on the shaft 69 and the shaft 69 is illustrated in FIG. 1 connected with a chain drive mechanism so as to rotate in synchronism at a predetermined rate of speed. The rate of speed is, of course, related to the rate of speed of the other rollers shown in FIG. 5.

Returning again to FIG. 5, the roller 71 is illustrated in sectional view with the beveled fin 72 also shown. The roller 71 is spring mounted at 73 to urge it toward the lower roller 70.

The numeral 74 identifies a stationary framework which is carried above each of the rails 27 on opposite sides of the equipment. The framework 74 extends over the cut strips. The framework 74 includes the horizontal upper portion which is preferably full width of the equipment for receiving a number of nail guides generally indicated at 75. Additionally, the framework 74 supports a mounting carriage 76 which is duplicated on both sides for mounting a number of spacer rollers. The carriage 76 is spring mounted at 78. The carriage supports rollers 79, 80 and 81. The three rollers are preferably contacted against the top of the individual strips 15. The three rollers are all free wheeling and are not driven. The rollers 79, 80 and 81 are illustrated with a smooth exterior without guide fins, but alternatively, they may be equiped with guide fins to maintain the correct spacing between adjacent strips.

As viewed in the side view of FIG. 5, the rollers on the upper side of the path of the strips exceed by one the number of rollers on the lower side. If only one roller were on the lower side, a pair would be needed on the upper side. In the preferred embodiment, two rollers are formed on the lower side and are positioned in an alternating position with the rollers on the top side. The lower rollers are indicated by the numerals 82 and 83. The rollers 82 and 83 are driven, and are positioned opposite of the nails guides 75 supported by the upper framework 74.

The first lower roller 82 will be observed to have a number of lengthwise slots formed in it. The slots are adapted to be positioned immediately below the nail guide 75 at the instant that a nail is inserted into the strip. It will be recalled that the tack 16 is forced into the strip and is driven into the strip until the head is either recessed or flush with the top side of the strip and the point protrudes from the lower side. Since the point protrudes, the slot is rotated by the roller 82 to be in position to receive the protruding tip or point. The impact of the nail or tack delivered by the nail guide 75 is such that the strip tends to flex or give a little, but the amount of give is limited by the two lines of contact at that instant where the roller 82 supports the strip 15. At the instant the nail is driven through the wood, the wood is supported along two lines of support on opposite sides of the point of emergence of the nail point. This supports the board or strip sufficiently to keep the nail at a precise angle and prevents lengthwise splits from forming in the laminates comprising the plywood material. Further, the lengthwise slot formed in the roller 82 forms a receptacle into which the nail can protrude without striking any portion of the rotative equipment. Moreover, the slot is deeper than the amount of nail protruding from the lower side of the strip. More will be noted concerning the synchronizing of the time of nailing with the position of the lengthwise slots on the roller hereinafter. The roller 82 is shown in the preferred embodiment as having four slots, although through the use of different gear ratios, a roller with a different number of slots can be used.

It will be recalled that three idler rollers 79, 80 and 81, are positioned on the top side of the strip. Two rollers are positioned below. The roller 82 just described is positioned opposite the first nail guide 75. A second nail guide 75 is likewise supported by the frame 74. The two nails guides together place the two files of nails 22 and 23 respectively shown in FIG. 4. Again, if a different number of nails were required, say three files, three nail guides would be associated with each strip and appropriate rollers would be positioned below in accordance with the teachings herein disclosed.

Figure 7:
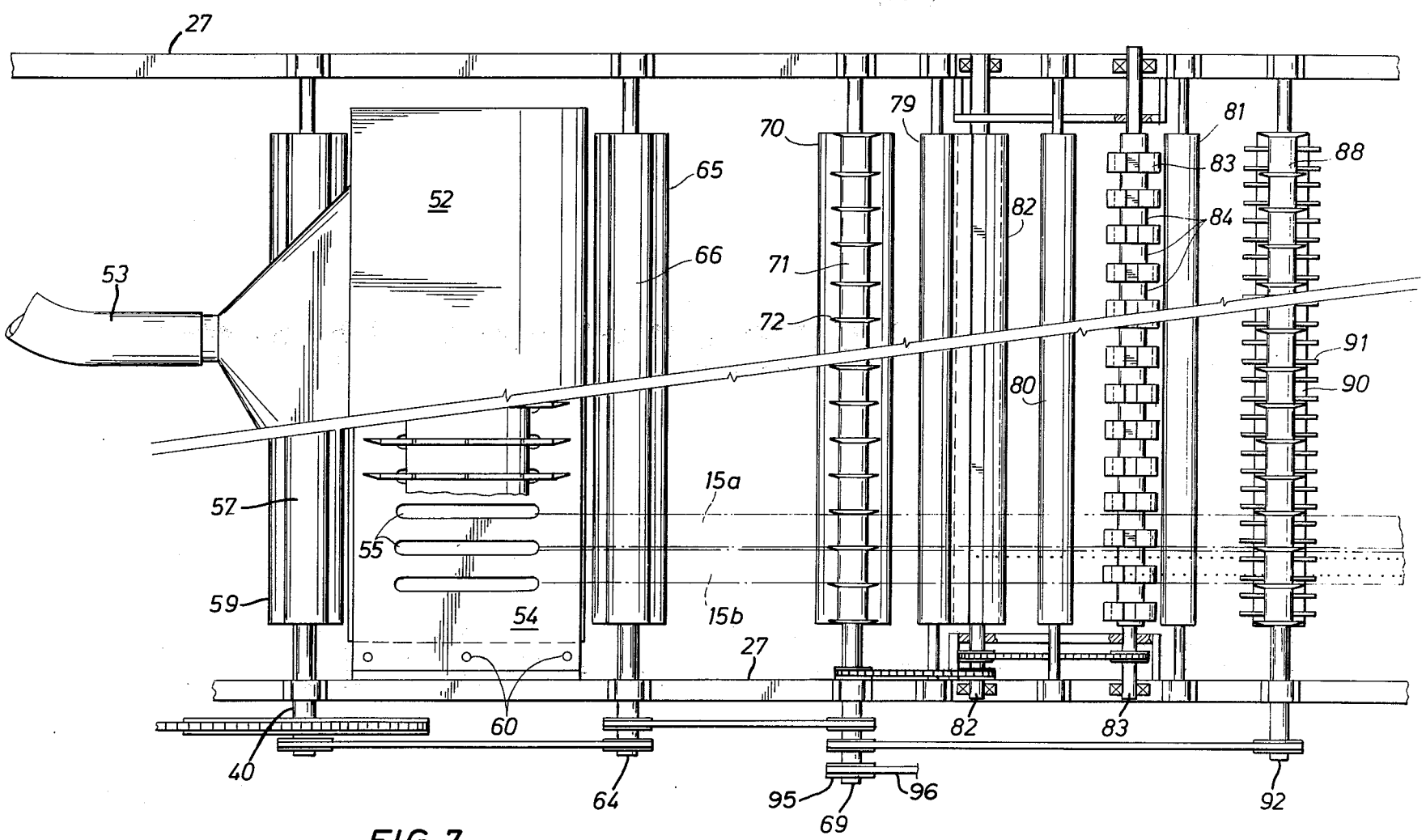
FIG. 7 is a sectional view taken along the line 7—7 in FIG. 1 showing the relative placement of feed rollers and guide rollers in conjunction with the several cutters which form the whole sheet into individual strips.

The roller 83 is similar to the roller 82 in that it includes the lengthwise slots for receiving the nails therein. The roller 83 functions in a similar manner to the roller 82 so that nails driven from the guide 75 puncture through the wood and emerge into the slot formed in the roller 83. They provide the same function in that they support the multi-layered plywood at the instant of nailing and also limit lengthwise splitting. However, the roller 83 is formed differently from the roller 82. It will be recalled that the nails are alternatively positioned as shown in FIG. 4. Accordingly, the nails previously placed in the slots of the roller 82 do not coincide with the position of the slots on the roller 83. The roller 83 would interfere with the passage of the strip because of the protruding nails placed in the first file. As shown in FIG. 7, the roller 83 not only possesses lengthwise slots formed in it, but also has portions of reduced diameter at 84 where the nails of the first file are located. The portions of reduced diameter thus permit the nails to pass by without interference. The actual spacing or timing of the first file of nails with respect to the second file is immaterial as will be noted upon viewing FIG. 7. The narrow diameter portions 84 are located along the length of the roller 83 in an alternative manner with one such portion being positioned for each particular strip formed by the apparatus.

Referring again to FIG. 5, the numeral 85 identifies a nail guide on the lower side of the strip 15. A fixed bar 86 is positioned just above the path of the strips 15. The bar 86 has a flat face and prevents the pre-nails from passing all the way through the strip. The nail guide 85 thus drives nails into the individual strips and the point penetrates until it strikes the plate 86. The strip 15 has the form illustrated in FIG. 2 wherein the tacks 16 extend all the way through and at an angle for gripping and engaging the carpet. The pre-nails 17 are properly positioned and centered among the two files and extend into the wood, but do not project from the opposite side. The top face 19 remains substantially smooth without nails for ease of handling while the bottom face 20 has both sets of nails projecting from it.

The nail guide 85 thus sets the last nail required for the strips. Since the apparatus of the present invention operates continuously as a sheet of plywood 11 first enters the cutters and as individual strips are formed and continue to travel to the right, all three nail guides may operate simultaneously to position nails in the strip as it traverses the equipment.

An additional set of rollers is included as illustrated in FIG. 5. The numeral 88 identifies a guide roller which is identical to the guide roller 71 previously identified. It is spring mounted at 89 and is forced toward a lower roller 90. The roller 90 is shown better in FIG. 7 and carries a number of relativey thin radial fins 91 which contact the lower face of the strip between the various rows of nails. The pair of rollers 88 and 90 provide additional impetus for the strips as they are manufactured. The roller pair pulls the strips through the nail setting equipment previously described and directs it toward the right hand end of the equipment as illustrated in FIG. 1. The rollers 88 and 90 comprise the last pair of rollers in the equipment. The roller 90 preferably is formed of resilient material and supports a number of fins 91. The roller 90 is received on a shaft 92 which is driven in synchronism with the other rollers 65 and 70 previously described.

Attention is next directed to FIG. 7 of the drawings where the drive system should be noted. The shafts 40, 64, 69 and 92 protrude on the side of the frame member 27 and gears having suitable ratios are used. Flexible drive chains connect from gear to gear. The slotted rollers 82 and 83 are connected together and rotate in unison. The shaft 69 extends on the outboard side of the other rail or frame member 27 and carries a pulley 95 which is connected by means of a suitable chain drive 96. A gear system can be used. The chain drive 96 extends to the nail separator and supply mechanism which will be described hereinafter. The slotted rollers 82 and 83 must be synchronized with the flow of nails and operation of the nail guides. Once they are turned on, the rotative speed matches the tangental or surface speed of the strip.

Attention is momentarily directed to FIG. 7 of the drawings. The numeral 15*a* identities a first strip which is formed by cutting, and the numeral 15*b* identifies a second strip which is adjacent. The two strips are guided through the apparatus by the various guide rollers. The strip 15*b* is shown with nails in it. The first file of nails passes through the roller 83 at the narrow portions 84. The finished strip continues on to the right.

Figure 9:
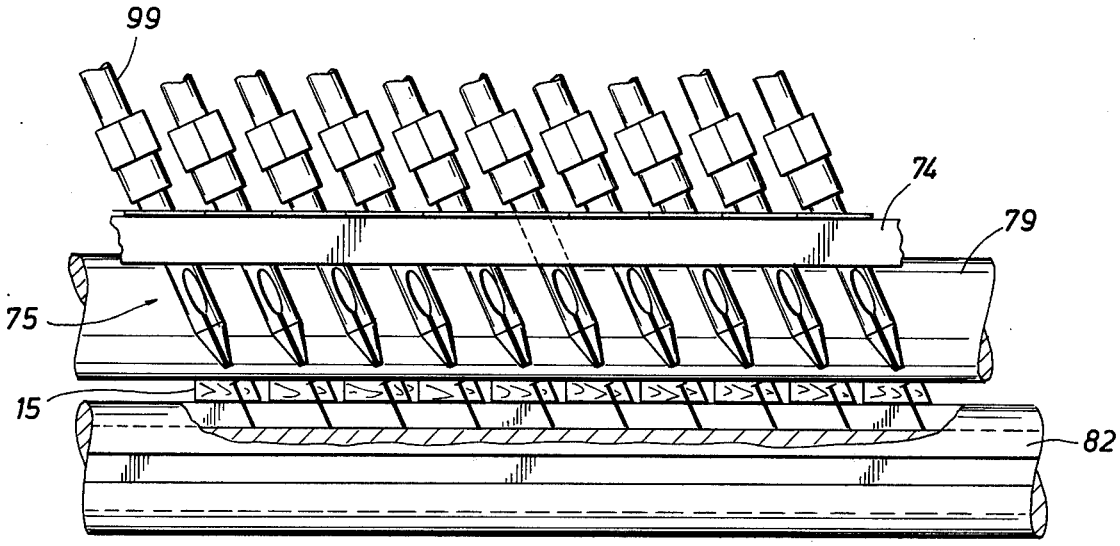
FIG. 9 is a sectional view taken along the line 9—9 of FIG. 5 showing a number of similar nail guides which direct and insert nails into the individual strips.

Attention is next directed to FIG. 9 of the drawings which is a view across the width of the apparatus 10 and illustrates a number of nail guides 75. The nails guides are preferably allocated two to each strip. If the apparatus forms ten strips simultaneously, twenty individual nail guides are required. All of the nail guides 75 are supported by the overhead framework 74. Each one is pneumatically operated and a pneumatic line 99 is provided for each nail guide. The line 99 supplies air and nails, the source to be described hereinafter. The nail guides indicated generally at 75 are all positioned at an angle approximately 27° with respect to the vertical. This can be varied depending on the angle to be imparted to the finished strips. Since the nail guides extend at an angle, the nails pass through the strips and extend at an angle.

FIG. 9 shows a number of individual strips caught between the rollers 79 and 82. It will be recalled that the roller 79 is behind the nail guides as viewed in FIG. 9 while the roller 82 is immediately below the nail guides. The roller 82 is slotted as previously mentioned. The nails are fired pneumatically from the nail guides and into the strips. The nail protrudes into the slot in the roller 82. Reduced air pressure will reduce the penetration of the individual nails. Preferably, the pressure is maintained at an optimum so that the nails penetrate sufficiently to bottom out with the head slightly recessed. This happens simultaneously across the width of the equipment so that if ten strips are made, all ten nails are fired simultaneously and emerge from the nail guides illustrated in FIG. 9 simultaneously.

Attention is next directed to FIG. 10 of the drawings. FIG. 10 illustrates another group of nails guides 75 which place the scond set of nails. The first file of nails is shown protruding from the lower side of the strips 15. The second set or file of nails is inserted by this equipment. Of particular interest is the position of the two files of nails with respect to the slotted roller 83. The second file of nails which is inserted by the nail guides 75 is always positioned when a slot in the roller 83 is adjacent to the nether side of the strip. The longitudinal position of the individual nails in the first file is immaterial as will be observed in FIG. 10. The roller 83 positions its lengthwise slot beneath the row of nail guides so that a full row of nails can be set across the width of the equipment simultaneously with the nails extending into the slot on the roller 82. This is accomplished without interference from the first row or file of nails.

FIG. 10 further illustrates the nail guides 75. The strips 15 emerge from the plane of the view toward the viewer. FIG. 10 illustrates how the pre-nails 17 are driven into the strips by a set of nail guides 85, but they do not pass through because of the metal backing bar 86. The nail guides 85 are similar to the others in the provision of pneumatic connections such as the pneumatic lines 100 shown in FIG. 10.

As will be recalled, once both files of nails are set and the pre-nails are added, the last pair of rollers contacts the plurality of parallel strips to drive them off the top of the equipment for packaging or other handling. This is illustrated in FIG. 11.

Figure 12:
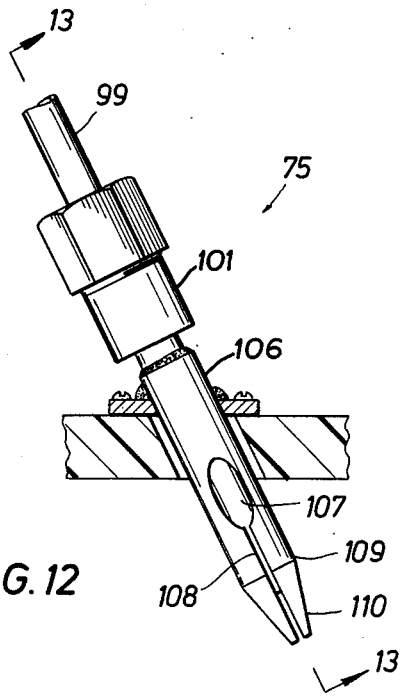
FIG. 12 is an enlarged view of one of the nail guides illustrated in FIG. 9.
Figure 13:
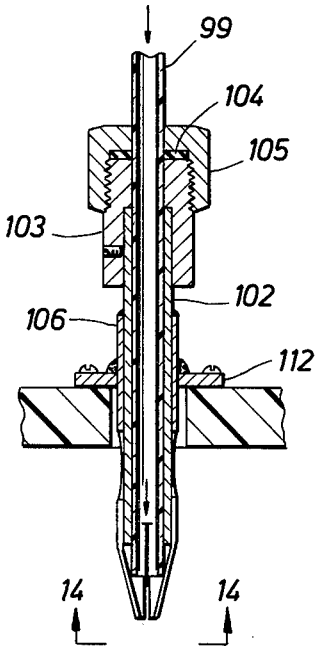
FIG. 13 is a sectional view taken along the line 13—13 of FIG. 12 illustrating internal details of construction of a nail guide.

The nail guides 75 and 85 are identical in all regards except for the cutaway portion (FIG. 10) of the lower nail guides which thereby permits the nails inserted but not buried to the head to emerge from the nail guides. The nail guides are shown in greater detail in FIGS. 12–14A, respectively. In FIG. 12, an individual nail guide is shown with the suitable fittings 101 for connecting the tubing member 99 to the individual assembly. Preferably, the tubing 99 extends well into the assembly. The tubing 99 can be formed of a resilient or elastomeric material. Preferred materials are relatively slick so that the nails do not catch as they travel through the tubing 99. One suitable material is nylon.

The tubing 99 extends full length of the nail guide mechanism. It is held in position and supported by a surrounding support member 102. The support member 102 surrounds the tubing 99 at its end and extends almost to the same length in the nail guide. The support member 102 extends upwardly into a threaded cap 103 which is fixed to the support member 102 by means of a set screw. The cap 103 supports a lock ring 104 and a threaded cap 105 forces the lock ring 104 into a locking position to fix the tube 99 with respect to the whole assembly. The tube 99 is not free to slide out of the assembly shown in FIG. 12 and 13.

The tube 99 is preferably made of a flexible material as mentioned before. In the nail guide assembly, the support 102 is concentric with it. An additional tubular member 106, formed of a fairly flexible metal material, is positioned on the exterior of the support member 102. The outer flexible metal member 106 extends to the lower portion of the nail guide as illustrated. It is drilled at two locations at 107 with stress relieving holes and slots 108 are formed at the lower end. The slots 108 extend from the holes to the lower opening. The slots 108 define a pair of fingers which are bent at 109. The tips of the fingers are illustrated at 110 and focused to a small central opening. The fingers 110 enclose the lower termination point of the flexible member 99 and the metal member 102 which surround it.

The upper portions of the outer cylindrical member 106 are used to provide a point of connection and support. A flat metal plate 112 is bolted or otherwise joined to a suitable frame member for anchoring the nail guide 75 in position. The outer tubular cylindrical member 106 and the plate 112 are joined by any suitable means such as soldering or brazing. Other members 102 and 106 likewise are preferably soldered or brazed.

A suitable metal for the outer cylindrical member 106 is copper. Beryllium copper provides even better spring action capable of millions of flexures without fatigueing. As viewed in FIG. 14, the nail guide opens to expose the tip or point of the nail 16. The slots 108 are shown. The slots 108 flex and open so that the entire nail can emerge from the lower end. This is shown in FIG. 14A where the nail 16 is shown at the instant the head of the nail clears the opening. Viewing the inside of the opening of the nail guide, the tubular member 99 and the surrounding member 102 are observed.

The modified nail guide 85 utilized herein has perhaps one quadrant cutaway from the tip of the nail guide to permit the head of the nail to clear the nail guide mechanism without interference, keeping in mind that the nail does not enter too far into the strip and is sufficiently long to extend into the nail guide once embedded.

Attention is next directed to FIG. 15 where a horizontal framework 120 supported on vertical members 121 receives and supports a nail storage bin 122. The bin 122 is of a suitable size to receive a supply of nails which will last for a period of time. The nails are dumped into the bin 122. The bin 122 preferably has a width approximately equal to the apparatus, although this is not mandatory. The bin 122 has a slot across its lower edge more or less located at 123. The bin 122 is filled with nails and a shaker 124 vibrates nails towards the slot 123. The slot 123 is positioned above a generally flat pan 125 and the nails fall in the pan 125 and tumble downhill. Again, the pan 125 has a vibrator 126. The vibrator 126 agitates the pan causing the nails to tumble and roll toward the lower end. The pan 125 is positioned above another pan 128. Thus, the pan 128 slopes back in the opposite direction toward a nail sorting mechanism as will be described. The pan 128 is likewise equiped with an additional shaker 129. As the nails travel over the described route, they are evenly distributed across the width of the equipment.

The sloping pans 125 and 128 cooperate together to spread the nails more or less evenly across the width of the apparatus. Suppose for sake of discussion, that the apparatus is 24 inches wide. The nails in the bin sometimes have occasion to bunch up so that too many nails are dumped at one portion of the width, while another portion is somewhat starved for nails. This may be the result of partial jamming at the slot 123. Through the use of the rather long slopping surfaces and associated vibrators, the nails are spread more evenly. In any case, they slide along the pan 125 and off its lower end and then along the pan 128 and off its lower end. At this juncture, the nails are on the nail separator which will be described utilizing FIG. 16 of the drawings.

The nail separator shown in FIG. 16 incorporates a number of parallel rods indicated by the numeral 130 and 131. They are parallel to and spaced from one another by a distance less than the width of the head of the tacks. The slot between adjacent bars is sufficient for the point to drop through, but not the head. As viewed in FIG. 16, the nails fall on the several parallel round rods and are jiggled downwardly by vibrators as will be described.

A brush 132 and the motor which rotates the brush is indicated by the numeral 133. An upstanding bracket supports the motor 133. The brush causes the nails to point downwardly.

A transparent elastomeric cover 134 covers the lower portion of the nail separator. It is placed over the round bars 130 and 131 to keep the nails from jiggling upwardly and jumping out of the slots.

The nail separator is fabricated on a rectangular framework including end pieces 136 and 137 and parallel side pieces 138. A transverse member 139 is near the end piece 137. A space is defined between the frame members 137 and 139 for receiving a power transmission network as will be described hereinafter. A relatively wide support bracket 140 spans the width of the equipment and is joined to the side rails 138. It supports a plurality of vibrators 141 which shake the entirety of the nail separator. This helps jiggle the nails downhill into the slots between the adjacent bars.

For a better understanding of the nail separator top, attention is next directed to FIG. 19 of the drawings. In FIG. 19, an enlarged view shows the lower ends of several of the rods 130 and 131. The rods 130 are fixed in position by the transverse frame member 139. The rods 130 are notched at 144. The rods 131 are adapted to rotate. The upper rod in FIG. 19 should be considered in detail. The rod 131 is comprised of two portions, the upper portion being indicated by the numeral 146 and the lower portion being indicated by the numeral 147. The portion 146 does not rotate, but the portion 147 does rotate. The interconnection between the rod portions 146 and 147 is achieved by positioning a stem 148 in a central drilled opening 149. The opening 149, and the axial extension 148, thus center the rod 147 in the opening 149. A small hole to the exterior is incorporated in communication with the counterbored opening 149 to permit the insertion of a lubricant such as graphite. Thus, the rod 146 does not rotate while the portion 147 does.

At this juncture, it should be observed that a narrow slot is defined between each pair of rods. The slot is large enough to receive the shank of the tacks, but not large enough to permit the head to pass through. The nails slide down until they reach the portion 147. The rotating portion 147 carries on its exterior a helix 150. The helix 150 rotates so that the forwardmost point or edge forces its way between the heads of two adjacent nails as shown in FIG. 19. The spacing or pitch of the helix 150 is such that individual nails are captured between turns of the helix. This is shown better in FIG. 19. The helix then carries the nails from the beginning or upper end of the helix towards the lower end. The rod 147 is notched at 152. The helix progresses the nails downwardly between the adjacent rods until each nail drops through the notch 144 or 152. It will be noted that a tangental hole or drop-through notch is formed in each rod while each helix serves double duty for itself and the two adjacent rods. As shown in FIG. 20, a nail is just dropping through the opening. The tangental hole 152 is sufficiently large for the head of the nail to drop through. It drops through another apparatus as will be described.

Attention is next directed to FIG. 19 of the drawings where the numeral 160 identifies the drive shaft. A beveled gear 161 is carried on it. The gear 161 engages an additional beveled gear 162. The beveled gear 162 is common to the lower portions of one of the rotating shafts 131. The lower portion passes through the transverse frame member 139 and is likewise supported by a back-up plate 163. The plate 163 is parallel to the member 139. A plurality of gears is located between the two plates. The gears are better shown in the sectional view of FIG. 21. The numeral 164 identifies a first gear. It is engaged with a second gear 165 which rotates in the opposite direction. An additional gear 164 rotates in the same direction. The gear train extends all the way across the nail separator with alternating gears and idlers. All the gears 164 rotate in the same direction and at the same speed. All of the idler gears 165 rotate in the opposite direction and merely serve as a means of interconnection.

The gear train is received between the frame member 139 and the plate 163. The plate 163 is preferably L-shaped as shown in FIG. 20 and is joined to the frame member 139 at its bottom edge. The frame member 139 is drilled at the appropriate locations to receive the supporting shafts for the various gears.

Returning again to FIG. 16 of the drawings, a shaft 160 is connected to an azimuth indicating device 170 shown in detail in FIG. 16A. A gear 171 is connected with a link chain drive 172 which extends to an additional gear 173. The chain 96 previously mentioned is connected through a gear 174, and the gears 173 and 174 are connected by a magnetic clutch 175. The clutch 175 is turned on by a suitable switch (not shown) which applies power to it and energizes it. When it is energized, power is applied to the chain 96 to drive the slotted rollers 83 and 82. More will be noted concerning the timing of the operation of the clutch 175 hereinafter. The separator is driven from the single and common power source 32 by means of positive connection of a chain drive mechanism connected with the nail separator apparatus as shown in FIG. 16.

The drop of the nails should next be considered. As shown in FIG. 20, as the nails begin to fall from the tangental hole 152, they fall into a funnel-shaped block 180. Such a funnel-shaped block is provided at each point where a nail is dropped, and hencce is duplicated across the width of the nail separator. Attention is returned to FIG. 17 where the funnel-shaped block 180 is illustrated. It communicates by means of a generally downwardly passage 181 with a valve body. The numeral 182 identifies a line for air applied under pressure. An intersecting passage 183 is found in the body of the block 184. The passage 181 is enlarged at its lower end to receive a tubular member 185. The member 185 is connected with a flexible conduit or tubing member 99 which delivers the nail to the respective nail guides. The intersecting passage 183 is plugged at 187. An orifice plug 188 has a slight bleed hole in it for introducing air behind a ball check valve element 189. The ball is sized so that it rolls upwardly on the introduction of air pressure into the passage 183. The ball thus blocks the passage 181 and prevents air from going up the passage and attempt to blow a nail out of the funnel-shaped member 180, and air wastage is reduced. The lateral passage 182 intersects the main passage member 185 to direct the blast of air downwardly and into the tube 99. This blows the nail with sufficient velocity to cause it to pass all the way through the nail guide and to embed in the strip.

Relative timing between adjacent nail drop mechanisms is achieved through the use of a magnet 190 shown in FIG. 18. The magnet holds the nail inasmuch as the nails are practically always formed of ferromagnetic materials. The nails are all held for simultaneous nailing. The nails may drop out of the separator somewhat unevenly, but they are caught and held temporarily by the magnet. The valve mechanism shown in FIG. 17 associated with each nail drop mechanism is connected to a common manifold, and hence, delivery of air to the common manifold operates all of the nail drop mechanisms simultaneously to force the nails downwardly simultaneously. The nails travel at a high velocity, through the tubing members 99 point first. Since they are impelled by the same or common blast of air and travel equal common distances, they all arrive at the nail guides 75 described earlier substantially simultaneously and the nailed simultaneously. The backing bar 82 with its longitudinal or lengthwise slot is properly positioned with the slot up so that the nails all hit, embed, and pass through the plurality of strips simultaneously and all extend into the slot. The equipment nails in synchronism.

An alternative form of nail drop mechanism is shown in FIG. 17A. The numeral 200 indentifies the funnel-shaped member which receives the nail 16. A second member 201 narrows the funnel and erects the nail at an angle. The passage in the member 201 is at an acute angle with respect to the passage 202 and an additional member 203. The numeral 204 identifies an air inlet line which is threaded to the block 203 and which is adapted to deliver a substantial quantity of air through the passage 202. The numeral 205 identifies a ball shaped check valve element. It has a lower position determined by a constriction in the passage 202. Its upper position is determined at the point of intersection of passages 206 and 207. The passage 206 is large enough to receive the nail, but is smaller than the ball. The ball rolls upwardly under the blast of air and plugs the passage 206. This directs the entire blast of air downwardly for the duration of the blast of air. When the air blast terimates, the ball falls back to the position indicated in FIG. 17A. The passage 207 is of sufficient diameter to receive the member 185 therein, the magnet 190 being furnished in the same manner as that illustrated in FIG. 17.

Attention is next directed to FIG. 22 of the drawings where the shaft 160 is again illustrated. It carries a cam member 210 which is positioned by a switch 211. The signal is formed on suitable electrical conducters. Utilization of the signal is illustrated in FIG. 23.

FIG. 23 indicates a pneumatic control system. The numeral 220 identifies a gas or air line which is connected with a suitable off-on valve 221. The valve 221 is then connected to a solenoid control valve 222. The control valve is opened and closed in response to the switch 211 just described. It delivers air to a distribution manifold 223. The manifold 223 provides air to the conduits 182 to the valve mechanisms 188. These mechanisms are those illustrated in FIGS. 17 and 17A.

As represented schematically in FIG. 23, the manifold 223 is connected to two sets of valve mechanisms 188. These valves are utilized to form the two files of tacks 16 in each strip in the preferred embodiment. Thus, if the machine forms ten strips simultaneously, 20 individual valves are connected to the manifold 223. This provides two for each strip in the preferred arrangement.

The line 220 additionally connects to a master or control valve 224 which is then connected to an additional solenoid valve 225. This is connected with an additional manifold 226 which provides power for setting the pre-nails. The pre-nails are handled in the same manner as the tacks. The only difference is that they are not required in the same quantity. In the preferred version of carpet stripping, there is only one file of pre-nails in each strip while there are two files of tacks. Hence, typically only one half as many valves are required for operation of the pre-nail system. Pre-nails are spaced further apart along each strip; hence, the nail separator is operated at a lower rate of speed. This rate of speed is sensed by the utilization of a similar or identical cam and switch mechanism for controlling the valve 225. It is believed unnecessary to illustrate another nail separator since it functions in the same manner as previously described. Of course, it need be only half as wide, and it runs at a slower speed.

The several views of the present application have been described in detail. The many mechanisms which need to be considered to obtain an understanding of the present invention are shown in full. It is believed that the description of operation found herein and the detailed description of the several views will enable one skilled in the art to understand the present disclosure.

Many alterations and variations in the structure may suggest themselves and can be adapted. The apparatus can be altered in many regards. For instance, its width is substantially indefinite. It can be used to form greater or lesser numbers of individual but identical strips simultaneously. The output of the machine can be enhanced by running it at a greater speed. This is readily accomplished inasmuch as all the equipment is synchronized together and driven from a single power source. While the cutter blades have their own power source, they do not require synchronization with any other portion of the equipment. It is sufficient only that they run at an adequate rate of speed to cut a smooth edge or surface. Without excessive elaboration, it is believed that such alterations and variations as might be deemed appropriate under various and different circumstances can be incorporated in the present invention without departin from the scope thereof.

The scope of the present invention is determined by the claims which are appended hereto.

We claim:

1. Apparatus for forming carpet tack strips comprising a pneumatically blown nail setting means cooperatively arranged for setting nails in such a plurality of strips as they are advanced along parallel paths, said means setting a row of nails in parallel strips from the opposite side.

2. Apparatus for forming carpet tack strips, comprising:

means for temporarily receiving and securing a strip of material;

pneumatic tack setting means arranged for setting a plurality of tacks sequentially in such a strip of material;

nail setting means arranged for setting a plurality of nails in such a strip of material; and said tack setting means and said nail setting means being positioned to set nails and tacks from opposite sides of the strip of material and wherein said tack setting means is at least duplicated to form at least two rows of tacks for at least two of such strips parallel to one another.

3. Apparatus for forming carpet tack strips, comprising:

means for temporarily receiving and securing a strip of material;

pneumatic tack setting means arranged for setting a plurality of tacks sequentially in such a strip of material;

nail setting means arranged for setting a plurality of nails in such a strip of material; and said tack setting means and said nail setting means being positioned to set nails and tacks from opposite sides of the strip of material and wherein said receiving means includes means for advancing the length of the strip lengthwise past said tack setting means and the strip is tacked beginning at one end and progressing toward the other end thereof.

4. Apparatus for forming carpet tack strips, comprising:

means for temporarily receiving and securing a strip of material;

pneumatic tack setting means arranged for setting a plurality of tacks sequentially in such a strip of material;

nail setting means arranged for setting a plurality of nails in such a strip of material;

said tack settng means and said nail setting means being positioned to set nails and tacks from opposite sides of the strip of material; and wherein said receiving means advances first one strip end wise and subsequently a second strip past said tack setting means lengthwise and sequentially.

5. Apparatus for delivering a nail to be set in a carpet tack strip comprising:

means for dispensing a nail with the point oriented in a predetermined manner;

passage means for receiving a nail therein from said dispensing means sufficiently loose to enable air to blow by the nail as it blows the nail therealong;

valve means controllably introducing air under pressure behind the head of the nail to blow the nail through said passage means;

a magnet adjacent to said passage means for holding the nail prior to operation of said valve means; and said passage means having an extent sufficient to connect to a means for directing a nail from said passage means into a carpet tack strip.

6. Apparatus for placing a nail in a carpet tack strip comprising:

a hollow tube means which fits about a nail;

first means for introducing a nail into said tube means;

second means at one end of said tube means directing the nail toward a carpet tack strip;

a backing means in contact with the side of the strip opposite said second means, said backing means having at least a point of contact against the strip which is upgrain from the point at which the nail emerges from the strip wherein the nail is longer than the thickness of the strip;

said backing means further contacting the strip at a point downgrain from the point of emergence of the nail; and said backing means comprising a rotatable shaft having an axis of rotation perpendicular to the length of a carpet tack strip, and includes a notch having a pair of facing edges which contact the strip perpendicular to the strip.

7. The invention of claim 6 including means for simultaneously rotating said shaft and advancing the strip lengthwise against the rolling and rotating contact with said shaft.

8. The invention of claim 7 including means for placing a row of protruding nails in the strip prior to contact of said shaft, wherein said shaft contacts the strip only across a portion other than a portion of width including the row of previously placed nails.

9. The invention of claim 7 including a roller contacted against the side of the strip opposite from the side contacted by said shaft.

10. The invention of claim 9 wherein the strip has four sides in cross-section, and including guide means contacting the two remaining sides of the strip.

* * * * *